US005342995A

United States Patent [19]

Comerci et al.

[11] Patent Number: 5,342,995

[45] Date of Patent: Aug. 30, 1994

[54] PROTECTIVE COVER SYSTEM FOR ELECTRICAL RECEPTACLES

[75] Inventors: Joseph D. Comerci, Elmhurst; Mark M. Data, Bolingbrook; Robert DeRoss, Naperville, all of Ill.

[73] Assignee: Molex Incorporated, Lisle, Ill.

[21] Appl. No.: 122,874

[22] Filed: Sep. 16, 1993

Related U.S. Application Data

[63] Continuation of Ser. No. 790,955, Nov. 12, 1991, abandoned.

[51] Int. Cl.[5] ..... H01R 13/44

[52] U.S. Cl. ..... 174/67; 439/536; 439/892

[58] Field of Search ..... 174/66, 67; 439/135, 439/136, 137, 367, 426, 519, 521, 536, 892, 491; 220/241, 242; 428/40, 317.1, 317.5

[56] References Cited

U.S. PATENT DOCUMENTS

| | | | |
|---|---|---|---|
| 3,845,234 | 10/1974 | Brenner | 174/67 |
| 4,163,137 | 7/1979 | Chase, Jr. | 439/536 X |
| 4,479,317 | 10/1984 | Hanna | 439/491 X |
| 4,605,270 | 8/1986 | Aslizadeh | 439/135 X |
| 4,618,740 | 10/1986 | Ray et al. | 174/67 |
| 4,915,638 | 4/1990 | Domian | 174/67 X |
| 5,017,153 | 4/1991 | Bowman | 439/426 |

FOREIGN PATENT DOCUMENTS 950206 10/1956 Fed. Rep. of Germany .

*Primary Examiner*—Peter Dungba Vo
*Attorney, Agent, or Firm*—Stephen Z. Weiss

[57] ABSTRACT

A protective covering system is disclosed for use with an electrical receptacle having a front face with openings to receive prongs of an electrical plug. The system includes a protective cover having an adhesive backing for adhering to the front face of the receptacle and apertures for alignment with the openings. Locating projections protrude from the receptacle and locating holes are provided in the cover for registering with the locating projections on the receptacle to properly locate the cover thereon. Preferably, the adhesive backing is an adhesive strip substantially about the periphery of the back side of the cover, and the recessed area in the front face of the receptacle has a depth at least equal to the thickness of the cover.

10 Claims, 1 Drawing Sheet

PROTECTIVE COVER SYSTEM FOR ELECTRICAL RECEPTACLES

This is a continuation of copending application(s) serial number 07/790,955, filed on Nov. 12, 1991 now abandoned.

FIELD OF THE INVENTION

This invention generally relates to the art of electrical connectors and, particularly, to a cover means or system for protecting electrical connectors or sockets from dust, dirt or other foreign materials or objects.

BACKGROUND OF THE INVENTION

Electrical receptacles or sockets, particularly those that are mounted near a floor, are prone to accumulate dust, dirt and other foreign materials which migrate through the openings which receive the prongs of an electrical plug. In addition, such electrical receptacles may be hazardous if someone attempts to insert metal objects into the prong-receiving openings, resulting in electrical shocks.

Heretofore, various gaskets or covers have been used with standard or conventional electrical sockets of the type having a conventional face plate with openings, the sockets having apertures to receive prongs of an electrical plug. Examples of such gaskets are shown in U.S. Pat. Nos. 3,845,234 to Brenner, dated Oct. 29, 1974, and 5,017,153 to Bowman, dated May 21, 1991. Protective gaskets of the type shown in those patents usually are fabricated either with a special three-dimensional retaining shape or they are held in place by fastening means, all of which is expensive in mass production environments.

This invention is directed to providing a cover system for electrical receptacles which is extremely simple, relatively inexpensive and very easy to install.

SUMMARY OF THE INVENTION

An object, therefore, of the invention is to provide a new and improved cover system for protecting electrical receptacles having openings for receiving the prongs of electrical plugs.

In the exemplary embodiment of the invention, an electrical receptacle has a front face with openings to receive the prongs of an electrical plug. A protective cover has an adhesive backing for adhering to the front face of the receptacle, the cover having aperture means for alignment with the openings in the receptacle. Locating projections protrude from the receptacle, and locating holes are provided in the cover for registering with the locating projections to properly locate the cover on the front face of the receptacle.

As disclosed herein, the aperture means in the cover are provided in the form of slits which allow the plug prongs to pass therethrough but which prevent dust, dirt or other foreign materials from entering the receptacle. The adhesive backing on the cover is provided in the form of an adhesive strip substantially about the periphery of a back side of the cover. The front face of the receptacle has a recessed area within which the cover is positionable. The recessed area has a peripheral configuration complementary to that of the cover. The recessed area also has a depth at least equal to the thickness of the cover.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
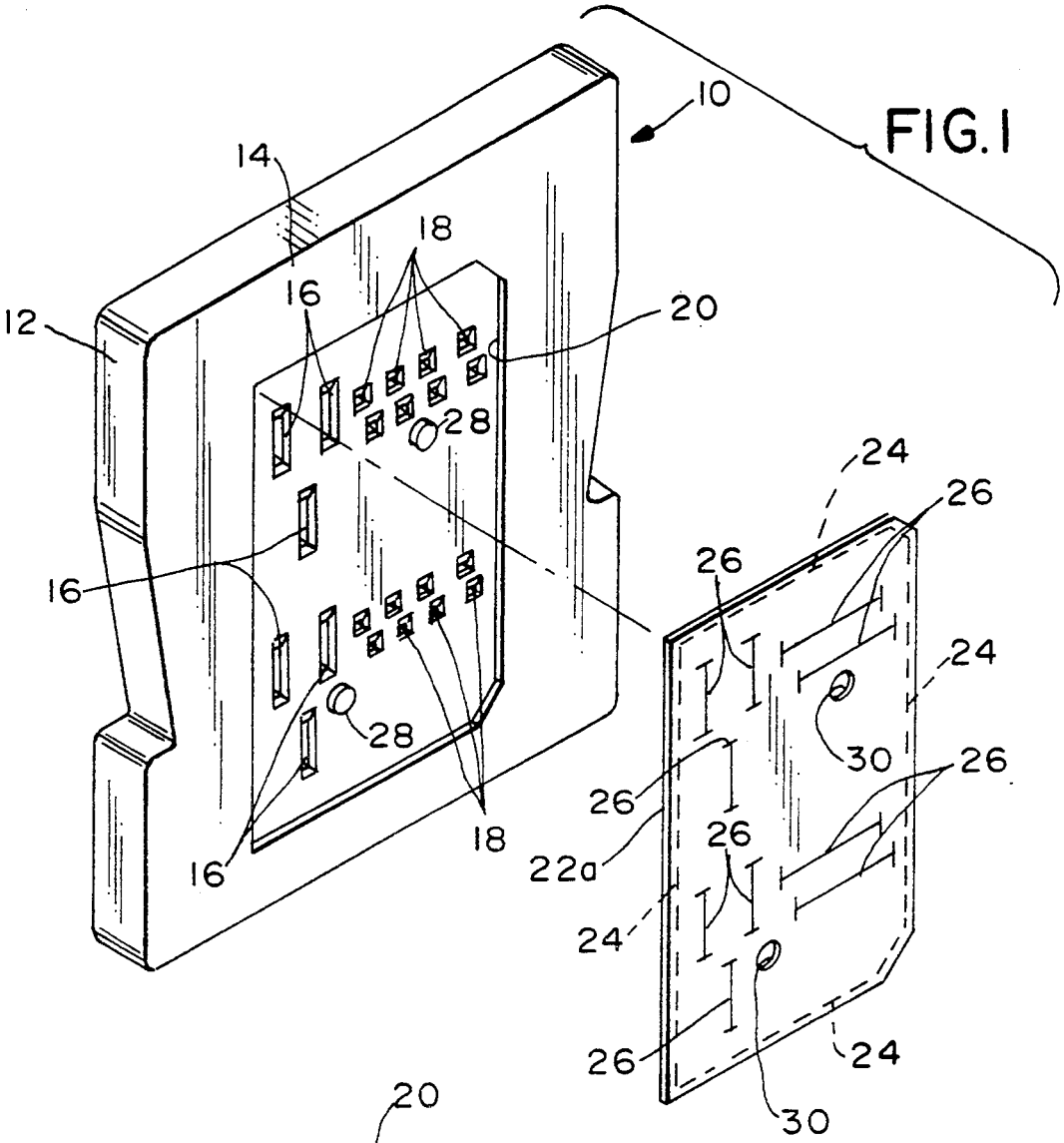
FIG. 1 is an exploded perspective view of an electrical receptacle and the cover means of the invention.

Referring to the drawings in greater detail, and first to FIG. 1, the protective cover system of the invention is designed for use with an electrical receptacle, generally designated 10, which includes a housing 12 defining a front face 14. The front face has openings 16 for receiving the prongs of a pair of three-pronged electrical plugs, along with additional openings 18 for receiving the prongs of other electrical plugs. Openings 16 and 18 are located in a recessed area 20 in front face 14 of receptacle housing 12.

At this point, it should be understood that electrical receptacle 10 is shown somewhat schematic in FIG. 1 because the precise configuration or shape of the receptacle can vary considerably from that shown. The invention is useful in a wide variety of electrical receptacles or sockets, including a wide variety of configurations of openings for receiving the prongs of various electrical plugs.

The invention contemplates a protecting system which includes a thin cover 22, such as of a polyester-type film which may be on the order of 0.010 to 0.001 inch thick. The cover is sized and shaped complementary to recessed area 20 in front face 14 of receptacle 10. The depth of recessed area 20 is at least equal to the thickness of cover 22 so that the face of the cover does not project beyond the front face of the receptacle. Preferably, the depth of the recessed area is approximately equal to the thickness of the cover so that the front face of the assembly would be substantially flush.

Generally, cover 22 is provided with an adhesive backing for adhering to the front face of receptacle 10. Specifically, in the preferred embodiment, an adhesive strip 24 is applied about the periphery of the back side **22*a* of the cover, whereby the cover adheres to the receptacle about the perimeter of recessed area 20**.

The cover has aperture means in the form of slits 26 which, when the cover is properly adhered within recessed area 20, are aligned with prong-receiving openings 16 and 18 of the receptacle. The slits are shown in the exemplary embodiment as generally "I" shaped. With the cover being fabricated of thin polyester-type material or film, the slits allow the prongs of electrical plugs to pass therethrough and into openings 16 and 18 of the cover. However, upon removal of the electrical plugs, the slits will close under the resiliency of the polyester cover to prevent dust, dirt or other foreign materials from passing therethrough into the receptacle.

Locating means also are provided between the cover and the receptacle for facilitating proper location of the cover. Particularly, a pair of locating pins 28 project from the front face of receptacle 10 within recessed area 20. A pair of locating holes 30 are provided in cover 22 for registering with the locating pins to properly locate the cover on the receptacle within the recessed area in the front face of the receptacle.

Figure 2:
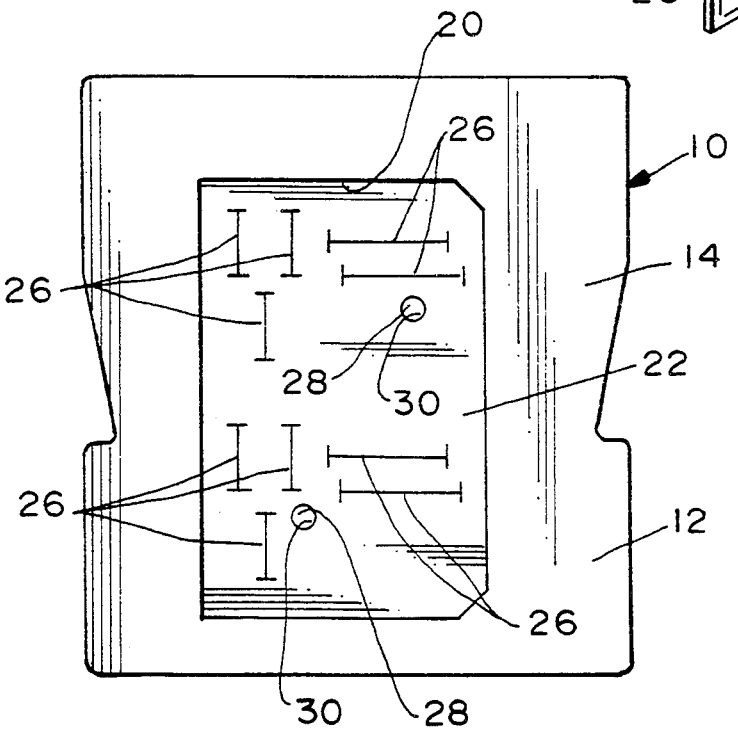
FIG. 2 is an elevational view of the front face of the receptacle, with the cover in proper position.

FIG. 2 shows an elevational view of the front face of the receptacle, with cover 22 properly located and positioned within recessed area 20. It can be seen that the only visible access means to the receptacle are the slits 26 in the cover, which are registered with the openings 16 and 18 in the receptacle, behind the cover.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical receptacle having a generally flat front face with openings to receive prongs of an electrical plug, the improvement comprising a protective cover having an adhesive backing for adhering to the front face of the receptacle and aperture means for alignment with the openings, locating projections separate from said openings protruding from and integral with the receptacle front face, said protective cover having locating holes therein corresponding to locating projections, said locating holes registering with the locating projections on the receptacle front face to properly locate the cover thereon.

2. In an electrical receptacle as set forth in claim 1, wherein said aperture means in the cover comprise slits.

3. In an electrical receptacle as set forth in claim 1, wherein said adhesive backing comprises an adhesive strip substantially about the periphery of a back side of the cover.

4. In an electrical receptacle as set forth in claim 1, wherein said front face of the receptacle has a recessed area within which the cover is positionable.

5. In an electrical receptacle as set forth in claim 4, wherein said recessed area has a depth at least equal to the thickness of the cover.

6. In an electrical receptacle as set forth in claim 4, wherein said recessed area has a peripheral configuration complementary to that of the cover.

7. In an electrical receptacle having a front face with openings to receive prongs of an electrical plug, the improvement comprising a generally flat recessed area in the front face of the receptacle including said openings, said front face formed into a sealed continuous surface with the exception of said openings in said recessed area, a protective cover having an adhesive backing for adhering to and being supported entirely by the recessed area of the receptacle and aperture means in said cover for alignment with the openings in said recessed area, said cover formed into a flat continuous non-broken sheet of plastic film with the exception of said aperture means in said sheet, and wherein the recessed area in the front face of the receptacle has a keyed peripheral configuration complementary to that of the cover.

8. In an electrical receptacle as set forth in claim 7, wherein said recessed area has a depth at least equal to the thickness of the cover.

9. In an electrical receptacle as set forth in claim 7, wherein said aperture means in the cover comprise slits.

10. In an electrical receptacle as set forth in claim 7, wherein said adhesive backing comprises an adhesive strip substantially about the periphery of a back side of the cover.

* * * * *